US010119407B2

(12) United States Patent
Levine

(10) Patent No.: US 10,119,407 B2
(45) Date of Patent: Nov. 6, 2018

(54) TAPERED THERMAL BARRIER COATING ON CONVEX AND CONCAVE TRAILING EDGE SURFACES

(71) Applicant: UNITED TECHNOLOGIES CORPORATION, Hartford, CT (US)

(72) Inventor: Jeffrey R Levine, Vernon Rockville, CT (US)

(73) Assignee: United Technologies Corporation, Farmington, CT (US)

( * ) Notice: Subject to any disclaimer, the term of this patent is extended or adjusted under 35 U.S.C. 154(b) by 478 days.

(21) Appl. No.: 14/767,699

(22) PCT Filed: Dec. 30, 2013

(86) PCT No.: PCT/US2013/078179
§ 371 (c)(1),
(2) Date: Aug. 13, 2015

(87) PCT Pub. No.: WO2014/143360
PCT Pub. Date: Sep. 18, 2014

(65) Prior Publication Data

US 2015/0369060 A1 Dec. 24, 2015

Related U.S. Application Data

(60) Provisional application No. 61/765,883, filed on Feb. 18, 2013.

(51) Int. Cl.
*F01D 5/28* (2006.01)
*F01D 5/18* (2006.01)
(Continued)

(52) U.S. Cl.
CPC ..... *F01D 5/288* (2013.01); *F01D 5/185* (2013.01); *F01D 5/187* (2013.01); *F01D 9/02* (2013.01);
(Continued)

(58) Field of Classification Search
CPC ..... F01D 5/288; F01D 5/18–5/189; F01D 25/12; F05D 2230/90; F05D 2240/304; F05D 2240/122; Y02T 50/676
See application file for complete search history.

(56) References Cited

U.S. PATENT DOCUMENTS 4,121,894 A 10/1978 Cretella et al.
5,225,246 A 7/1993 Beers et al.
(Continued)

FOREIGN PATENT DOCUMENTS

EP 2362068 A1 8/2011
EP 2418357 2/2012

OTHER PUBLICATIONS

European Office Action for European Application No. 13877747.9 dated Jul. 5, 2017.

*Primary Examiner* — Mark Laurenzi
*Assistant Examiner* — Xiaoting Hu
(74) *Attorney, Agent, or Firm* — Bachman & LaPointe, P.C.

(57) ABSTRACT

A turbine engine component has an airfoil portion having a pressure side, a suction side, and a trailing edge. The trailing edge has a center discharge cooling circuit, which center discharge cooling circuit has an exit defined by a concave surface on the pressure side of the airfoil portion and a convex surface on the suction side of the airfoil portion. The airfoil portion has a thermal barrier coating on the pressure side and the suction side. The thermal barrier coating on the convex surface tapers to zero in thickness at a point spaced from the trailing edge so as to leave an uncoated portion on the convex surface.

8 Claims, 3 Drawing Sheets

(51) Int. Cl.
*F01D 25/12* (2006.01)
*F01D 9/02* (2006.01)

(52) U.S. Cl.
CPC ..... *F01D 25/12* (2013.01); *F05D 2220/30* (2013.01); *F05D 2230/312* (2013.01); *F05D 2230/313* (2013.01); *F05D 2230/90* (2013.01); *F05D 2260/231* (2013.01); *F05D 2300/21* (2013.01); *Y10T 29/49343* (2015.01)

(56) References Cited

U.S. PATENT DOCUMENTS

| | | | | |
|---|---|---|---|---|
| 6,077,036 | A | 6/2000 | Heffron et al. | |
| 6,106,231 | A * | 8/2000 | Brainch | F01D 5/20 29/527.2 |
| 6,126,400 | A | 10/2000 | Nichols et al. | |
| 6,364,608 | B1 | 4/2002 | Brainch et al. | |
| 7,094,034 | B2 | 8/2006 | Fukuda et al. | |
| RE39,320 | E | 10/2006 | Nichols et al. | |
| 8,070,454 | B1 * | 12/2011 | Rawlings | F01D 5/288 416/228 |
| 9,267,383 | B2 | 2/2016 | Batt et al. | |
| 2007/0148003 | A1 * | 6/2007 | Trishkin | F01D 5/18 416/241 R |
| 2010/0014962 | A1 | 1/2010 | Arrieta et al. | |
| 2012/0156049 | A1 * | 6/2012 | Hong | B23P 6/007 416/224 |
| 2013/0058787 | A1 * | 3/2013 | Batt | F01D 5/288 416/95 |

* cited by examiner

TAPERED THERMAL BARRIER COATING ON CONVEX AND CONCAVE TRAILING EDGE SURFACES

BACKGROUND

The present disclosure relates to a tapered thermal barrier coating applied to surfaces of a turbine engine component, such as a turbine blade.

As turbine inlet temperatures increase to improve engine thrust and cycle efficiency, advanced technologies are needed to cool the trailing edges of turbine blades while minimizing the amount of cooling flow used. The use of refractory metal cores to create high density patterns of cast cooling features generally provides high convective heat transfer at low cooling flow requirements. In turbine airfoil applications, the thermal heat load at the trailing edge of the airfoil is higher on the pressure side, or concave, airfoil surface relative to the suction side, or convex, airfoil surface.

Center discharge cooling circuits have been formed using a variety of fabrication techniques including, but not limited to, using refractory metal core. Such cooling is desirable to assist in the reduction of metal temperatures and to help achieve turbine life goals. Despite such a cooling circuit, there remains a large thermal gradient from the pressure side to the suction side due to the mismatch of heat loads. This thermal mismatch may increase the thermal strain across the airfoil, and may result in low thermal-mechanical fatigue life.

SUMMARY

In accordance with the present disclosure, there is provided a turbine engine component which broadly comprises: an airfoil portion having a pressure side, a suction side, and a trailing edge; said trailing edge having a center discharge cooling circuit; said center discharge cooling circuit having an exit defined by a concave surface on the pressure side of said airfoil portion and a convex surface on the suction side of said airfoil portion; a thermal barrier coating applied to said concave surface and applied to said convex surface; and said thermal barrier coating on said convex surface tapering to zero in thickness at a point spaced from said trailing edge so as to leave an uncoated portion on said convex surface.

In another and alternative embodiment, the turbine engine component further comprises the uncoated portion extending a distance up to 25% of a chord of said airfoil portion.

In another and alternative embodiment, the turbine engine component further comprises the thermal barrier coating on the concave surface tapering towards the trailing edge.

In another and alternative embodiment, the thermal barrier coating on the concave surface has a first thickness at a point remote from the trailing edge and having a second thickness which is as much as 70% less than the first thickness.

In another and alternative embodiment, the turbine engine component is a turbine blade.

In another and alternative embodiment, the cooling circuit is connected at one end to a source of cooling fluid.

Further in accordance with the present disclosure, there is provided a process for forming a thermal barrier coating on a turbine engine component which broadly comprises the steps of: forming a turbine engine component having an airfoil portion and a central discharge cooling circuit in a trailing edge portion of the airfoil portion having an exit defined by a concave surface on a pressure side of the airfoil portion and a convex surface on a suction side of the airfoil portion; forming a thermal barrier coating on the pressure side and the suction side of the airfoil portion; and the forming step comprising forming a thermal barrier coating on the convex surface tapering to zero in thickness at a point spaced from the trailing edge so as to leave an uncoated portion on the convex surface.

In another and alternative embodiment, the process further comprises forming the uncoated portion to have an extent which is up to 25% of a chord of the airfoil portion.

In another and alternative embodiment, the forming step further comprises tapering the thermal barrier coating on the concave surface towards the trailing edge.

In another and alternative embodiment, the step of tapering the thermal barrier coating on the concave side comprises tapering the thermal barrier coating so as to have a first thickness at a point remote from the trailing edge and a second thickness which is as much as 70% less than the first thickness at the trailing edge.

Other details of the tapered thermal barrier coating on convex and concave trailing edge surfaces are set forth in the following detailed description and the accompanying drawings wherein like reference numerals depict like elements.

DETAILED DESCRIPTION

Figure 1:
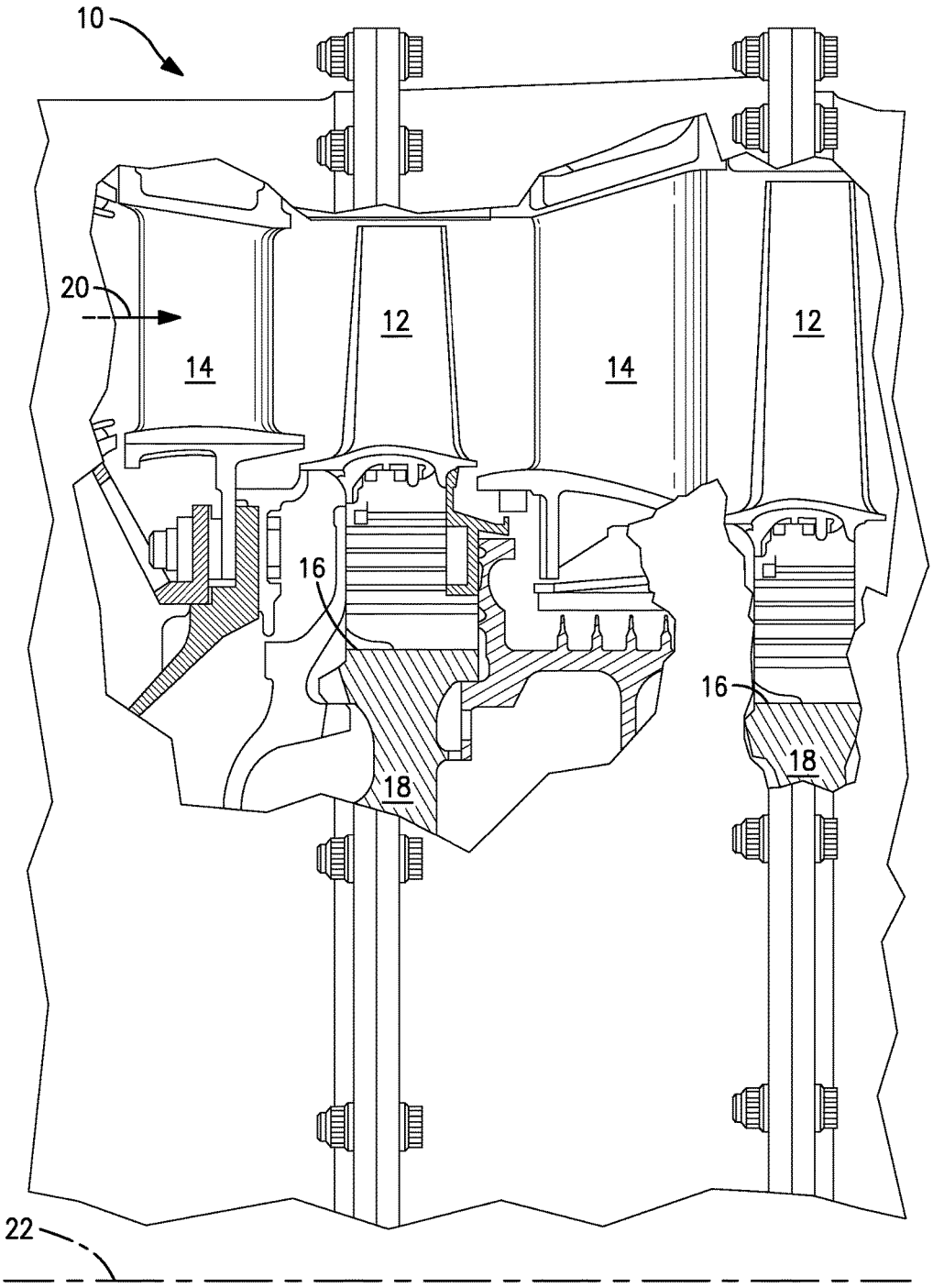
FIG. 1 is a partial schematic view of a turbine section of a gas turbine engine.

Referring now to FIG. 1, there is shown a turbine section 10 of a gas turbine engine. The gas turbine section 10 includes alternating stages of rotating blades 12 and stationary vanes 14. The blades 12 of each stage are circumferentially disposed about a radially outer rim 16 of a disk 18. The blades 12 may be integrally formed with the disk 18 or may fit within spaced, fir tree slots directed axially through the thickness of the rim 16. The blades 12 extract power from combustion gases 20 and transfer the power to the disks 18, which rotate about a central axis of the turbine section 10. In order to protect the blades 12 from the hot combustion gases 20, internal cooling passages and thermal barrier coatings may be utilized. In the exemplary figure, the blades 12 are disposed axially between the vanes 14 and interact aerodynamically therewith to provide a desired turbine performance and efficiency. It is to be understood that the blades 12 may be alternately positioned in other turbine section configurations.

Figure 2:
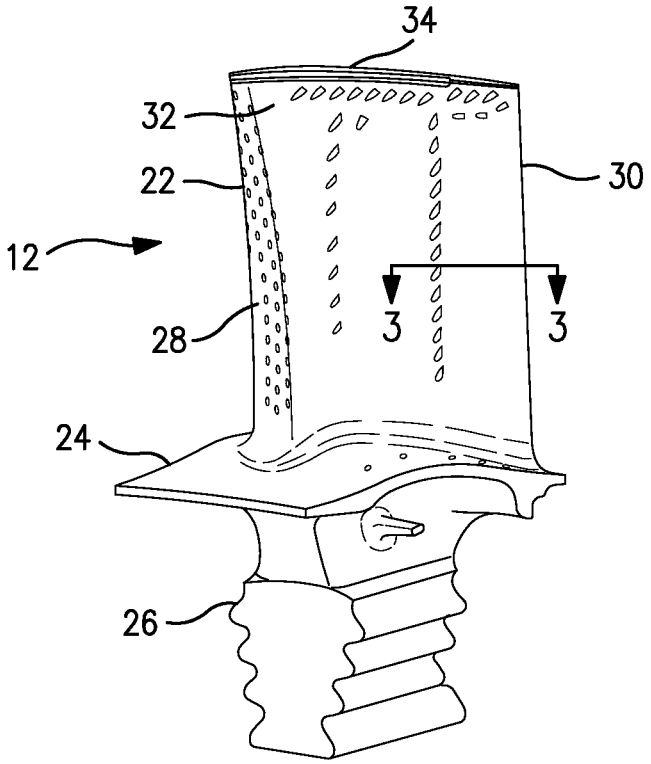
FIG. 2 is a view of a turbine blade.

FIG. 2 illustrates a turbine blade 12 which may be used in the turbine section 10. The blade has an airfoil portion 22, a platform 24 and a root portion 26 which fits into fir tree slots in the rim 16. The airfoil portion 22 of the blade 12 has a leading edge 28, a trailing edge 30, a pressure side 32 and a suction side 34.

Figure 3:
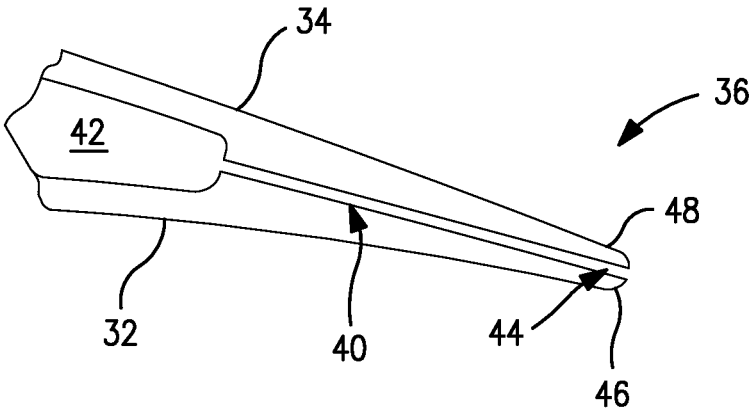
FIG. 3 is a sectional view of the blade of FIG. 2 taken along lines 3-3.

FIG. 3 is a sectional view of a trailing edge portion 36 of the airfoil portion 22. As can be seen from this figure, there is a trailing edge center discharge cooling circuit 40 which connects with a source 42 of a cooling fluid at one end and which terminates in at least one outlet nozzle or exit 44 at the opposite end. The at least one outlet nozzle or exit 44 may be defined by a concave surface 46 on the pressure side 32 and a convex surface 48 on the suction side 34.

Figure 4:
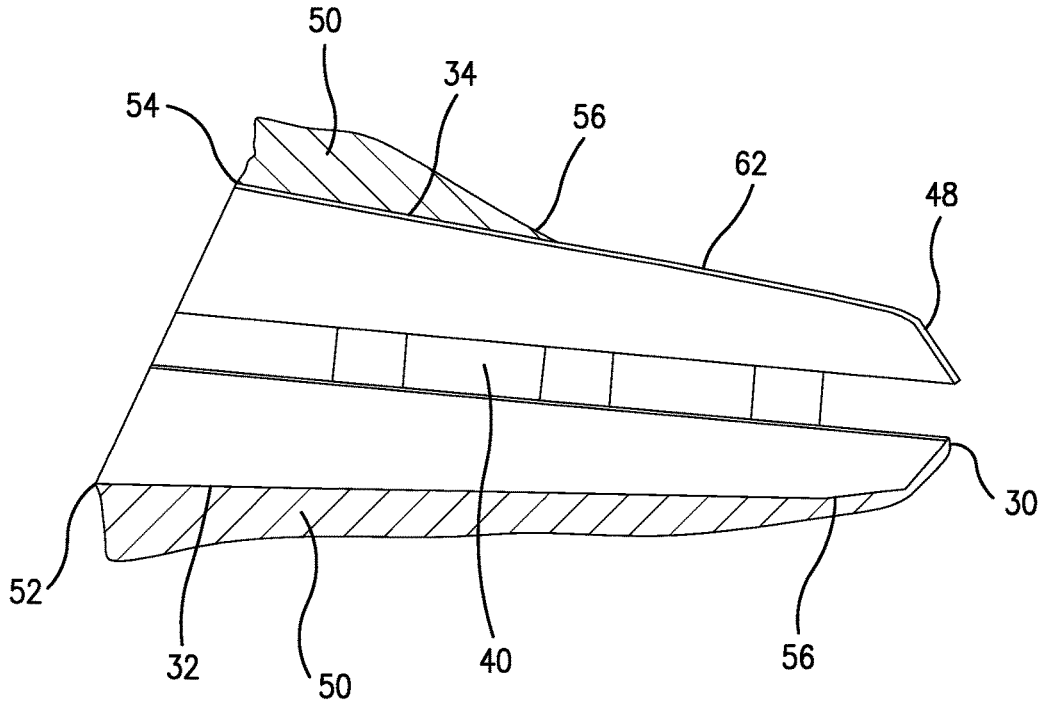
FIG. 4 is a sectional view of the trailing edge portion of the blade of FIG. 2 with a tapered thermal barrier coating.

Referring now to FIG. 4, the surfaces of the pressure side 32 and the surfaces of the suction side 34 may be covered by a thermal barrier coating 50. The thermal barrier coating 50 may be formed from any suitable ceramic coating material. For example, the thermal barrier coating 50 may be a ceramic coating, such as a coating formed from 7 wt % yttria stabilized zirconia (7YSZ) or from gadolinia-stabilized zirconia (GdZr). The thermal barrier coating 50 may be applied to the pressure side and suction side surfaces using any suitable technique known in the art including, but not limited to, EB-PVD, plasma spray deposition, air plasma spray deposition, and suspension plasma spray deposition.

The thermal barrier coating 50 on each of the pressure side and suction side surfaces may have a constant thickness from the leading edge 28 to a selected point on the respective surfaces. On the pressure side 32, the thermal barrier coating 50 may taper from a point 52 to the trailing edge 30. The point 52 may be located at up to 15% of the chord of the airfoil portion 22 from the trailing edge 30 at any point along the span of the airfoil portion 22. Thus, the thermal barrier coating 50 tapers over the length of the concave surface 46 at the trailing edge.

On the suction side 34, the thermal barrier coating 50 begins to taper from a second point 54 to a third point 56 spaced from the trailing edge 30. This leaves an uncoated portion 62 from the trailing edge 30 to the third point 56. The uncoated portion 62 may have a length which extends up to 25% of the chord of the airfoil portion 22 at any point along the span of the airfoil portion 22. The uncoated portion 62 may have a minimum length of 0.1% of the chord. On the pressure side 32, the thermal barrier coating 50 tapers from the point 52 to the trailing edge 30. Over this length, the thickness of the thermal barrier coating 50 may decrease by as much as 70%. In other words, the coating thickness at the trailing edge 30 may be 30% of the thickness of the coating 50 at the point 52.

The tapering of the ceramic coating thickness in the manner described above on both the concave and the convex surfaces helps to balance the metal temperatures between the pressure side and suction side trailing edge walls. The level of tapering may be determined by a desired thermal profile for the trailing edge 30. The tapered coating zone on both the concave and convex surfaces of the trailing edge may reduce the metal temperature difference between the concave and convex trailing edge walls to essentially zero. The result is a balanced temperature distribution at the trailing edge with high resistance to thermal mechanical fatigue cracking.

The tapering of the ceramic coating thickness in the region of the trailing edge may be accomplished using a technique known as shadowing where a shadow bar may be used to prevent a coater from depositing a coating in a particular area or depositing a reducing level of coating.

In accordance with the present disclosure, a turbine component 12, such as a turbine blade, may be formed with an airfoil portion 22 and a central discharge cooling circuit 40 at the trailing edge 30. The central discharge cooling circuit 40 may be formed using a refractory metal core (not shown). The central discharge cooling circuit 40 may be formed with a concave surface 46 on the pressure side 32 of the airfoil portion 22 and a convex surface 48 on the suction side 34 of the airfoil portion 22.

A thermal barrier coating 50 may be formed on the pressure side and suction side surface of the airfoil portion 22. The thermal barrier coating 50 may be formed using any suitable coating process known in the art, such as an EB-PVD coating process. In order to form a tapered coating over the concave surface 46, a shadow bar may be employed to prevent the coater from depositing coating material at certain points of the coating process. Alternatively, the flow of a coating powder may be controlled to created the desired tapering. On the suction side, the thermal barrier coating may be tapered so that there is an uncoated portion 62 on the convex surface 48 from the trailing edge 30 to the point 56.

There has been provided in accordance with the instant disclosure a tapered thermal barrier coating on convex and concave trailing edge surfaces. While the tapered thermal barrier coating has been described in the context of specific embodiments thereof, other unforeseen alternatives, modifications, and variations may become apparent to those skilled in the art having read the foregoing disclosure. Accordingly, it is intended to embrace those alternatives, modifications, and variations as fall within the broad scope of the appended claims.

What is claimed is:

1. A turbine engine component comprising:

an airfoil portion having a pressure side, a suction side, and a trailing edge;

said trailing edge having a center discharge cooling circuit;

said center discharge cooling circuit having an exit defined by a first surface on the pressure side of said airfoil portion and a second surface on the suction side of said airfoil portion;

said airfoil portion having a thermal barrier coating on said pressure side and said suction side;

said thermal barrier coating on said second surface tapering to zero in thickness at a point spaced from said trailing edge so as to leave an uncoated portion on said second surface; and said thermal barrier coating on said first surface tapering towards said trailing edge, wherein said thermal barrier coating on said first surface has a first thickness at a point remote from said trailing edge and a second thickness which is as much as 70% less than the first thickness at said trailing edge.

2. The turbine engine component according to claim 1, further comprising said airfoil portion having a chord and said uncoated portion extending a distance of up to 25% of said chord.

3. The turbine engine component according to claim 1, wherein said component is a turbine blade.

4. The turbine engine component according to claim 1, wherein said cooling circuit is connected at one end to a source of cooling fluid.

5. The turbine engine component according to claim 1, wherein said first surface is a concave surface and said second surface is a convex surface.

6. A process for forming a thermal barrier coating on a turbine engine component comprising the steps of:

forming a turbine engine component having an airfoil portion and a central discharge cooling circuit in a trailing edge of said airfoil portion having an exit defined by a first surface on a pressure side of said airfoil portion and a second surface on a suction side of said airfoil portion;

forming said thermal barrier coating on said pressure side and said suction side of said airfoil portion;

said forming step comprising forming said thermal barrier coating on said second surface tapering to zero in thickness at a point spaced from said trailing edge so as to leave an uncoated portion on said second surface, and said forming step further comprises tapering said thermal barrier coating on said first surface towards said trailing edge, wherein said step of tapering said thermal barrier coating on said first surface comprises tapering said thermal barrier coating so as to have a first thickness at a point remote from said trailing edge and a second thickness which is as much as 70% less than the first thickness at said trailing edge.

7. The process of claim 6, further comprising said airfoil portion having a chord and forming said uncoated portion to have an extent which is up to 25% of said chord.

8. The process of claim 6, further comprising forming said first surface as a concave surface and said second surface as a convex surface.

* * * * *